United States Patent [19]

Gagneraud

[11] 4,300,056

[45] Nov. 10, 1981

[54] PROCESS FOR MAKING PROTECTIVE BARRIERS AGAINST RADIOACTIVE PRODUCTS

[76] Inventor: Francis Gagneraud, 6, avenue des Tilleuls, Paris, France, 75016

[21] Appl. No.: 14,963

[22] Filed: Feb. 26, 1979

[30] Foreign Application Priority Data

Aug. 3, 1978 [FR] France ..... 78 22925

[51] Int. Cl.[3] ..... G21F 62/9

[52] U.S. Cl. ..... 250/517; 250/515; 252/629

[58] Field of Search ..... 250/506, 507, 515, 517, 250/518; 252/301.1 W, 478

[56] References Cited

U.S. PATENT DOCUMENTS 2,918,717 12/1959 Struxness et al. ..... 250/506
3,332,884 7/1967 Kelmar ..... 252/301.1 W

FOREIGN PATENT DOCUMENTS 2424697 12/1974 Fed. Rep. of Germany ..... 250/506
2516023 10/1976 Fed. Rep. of Germany ..... 250/517

OTHER PUBLICATIONS

"Treatment of Radioactive Slurry and Storage of Concentrated Waste", Queiser et al., Nucl. Eng. Int., Feb. 75, vol. 20, No. 225, pp. 108-110.

*Primary Examiner*—Bruce C. Anderson
*Attorney, Agent, or Firm*—Browdy and Neimark

[57] ABSTRACT

The outside environment is shielded from radioactive materials by surrounding the radioactive material with an enclosure formed from slowly cooled molten slag or scoria coming from a ferrous or nonferrous metal making operation. The enclosure may comprise walls, slabs or blocks of such material formed into a building, a conduit of such material for movement of radioactive effluents or a metal container separated from an outer metal container by such material.

10 Claims, 1 Drawing Figure

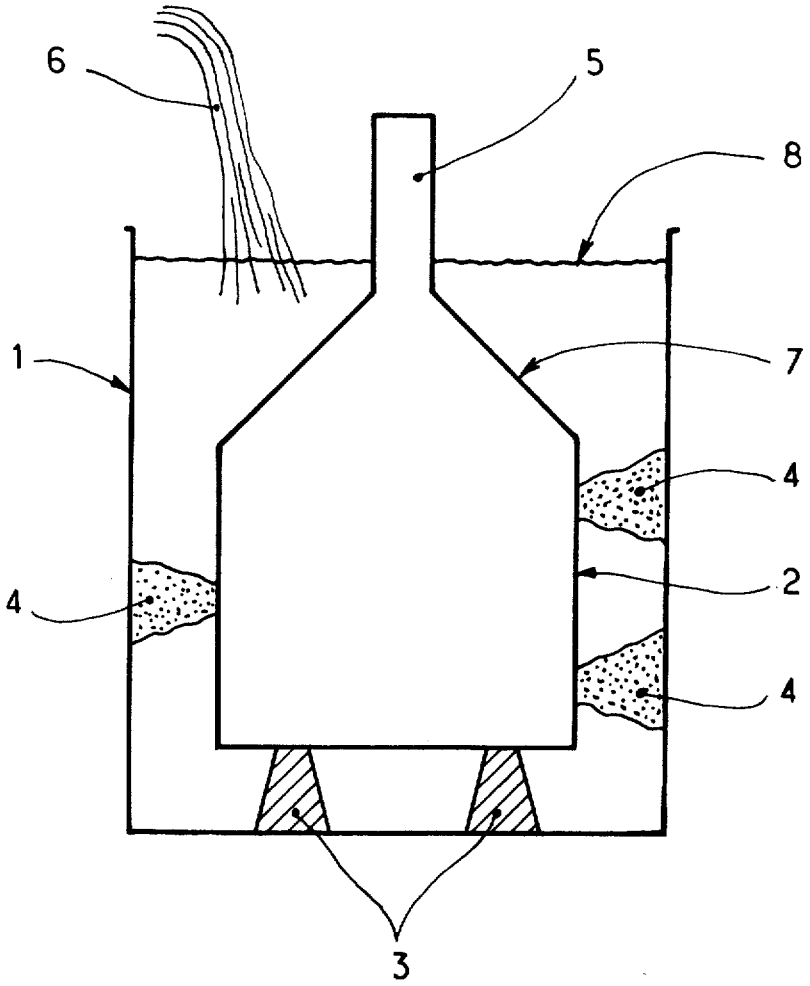
6
5
8
1
7
4
4
2
4
3

PROCESS FOR MAKING PROTECTIVE BARRIERS AGAINST RADIOACTIVE PRODUCTS

FIELD OF THE INVENTION

The present invention relates to the field of protection from radioactivity coming from matter, equipment, tools, clothing, resins, etc., used either in their first form or as wastes, and more particularly to a process for making a radiation protective shield.

BACKGROUND OF THE INVENTION

It is known that storage, handling and shipping of radioactive products, in the nuclear industry, pose serious protection problems.

When working with radioactive materials, for example in the manufacture and handling of nuclear fuels, it is necessary to provide for the construction of partitions, blocks, and/or buildings either of special materials such as lead walls, or of traditional materials, such as concrete, but with a very great thickness.

Another extremely bothersome problem is that related to radioactive wastes coming from the nuclear industry.

It is known that during manufacture of nuclear fuels and after use of these fuels, wastes are produced that have varying degrees of radioactivity. Other wastes also come from material, operating equipment, slurries, clothing and other contaminated objects. These residues and wastes are now stored close to their fabrication sites, but there is beginning to be a space shortage and there has been consideration to treating them before shipping, and storing them at a final site.

Various techniques have been proposed to treat these radioactive residues to facilitate their handling and storage. Liquid wastes can be solidified with such materials as cement, asphalt, schists, fly ash or be fixed in concrete of various compositions, e.g., mixture of glass and cement, mixture of vermiculite and cement, etc. According to another technique, highly radioactive liquid wastes are treated by a vitrification process that consists of concentrating the solution to complete dryness and causing the resulting dry product to go into the composition of an insoluble glass poured in blocks which are stored in hermetic deep wells. This technique requires an installation for concentrating the solution containing the radioactive elements and a mini-glassworks, the unit being in a building with walls able to stop dangerous radiation. Slightly or moderately radioactive residual products are generally enclosed in suitably thick steel containers which can be coated with tar or in concrete with a selected composition that can absorb radiation.

SUMMARY OF THE INVENTION

The main object of the present invention is to propose an inexpensive, very compact material offering excellent resistance to aggressive agents, to act as a barrier between a radioactive environment and an uncontaminated environment.

Another object of the present invention, of particularly advantageous application, is to provide a means for effective and economic packaging of solid or pasty, slightly or moderately radioactive wastes intended to be shipped and stored at a determined site.

In its most general form, the process for protecting from radiation of radioactive products according to the present invention consists of placing between the radioactive environment and the outside environment, elements made of materials selected from the group of molten slags and scorias coming from making ferrous and nonferrous metals.

These elements, acting as antiradiation barriers, can be of various types, such as, for example, walls or monolithic slabs of poured slag for putting up buildings sheltering the installations for fabrication or treatment of nuclear fuels; pipes of poured metallurgical slag for movement of the radioactive effluents in the treatment plants; poured slag blocks for putting up walls acting as radiation insulating barriers at storage sites; or containers in various shapes for insulating the entire volume to be buried, immersed or in the open air.

According to a particularly advantageous embodiment, the present invention relates to surrounding metal containers, usually used to enclose solid or pasty radioactive wastes, with molten metallurgical scorias or slags, these containers optionally being provided with a protective layer of refractory concrete.

According to a preferred embodiment of this process, a waste container is wedged in an empty large-size external drum, then molten slag is poured in the empty space between the two containers, the operation being followed by the slowest cooling possible to avoid any cracking and to obtain a compact coating.

The covering around the metal waste container can be made from molten slag coming directly from its ladle or pouring trough at the output of the blast furnace or other production device. To improve and facilitate the work, the fluidity of the slag can be increased by lowering the solidification temperature by adding to the slag such substances as sodium borate, sodium carbonate, siliceous sand, iron oxides or other suitable products.

In case the insulating elements according to the present invention are made up of walls, slabs or the like, they can be fabricated in the vicinity of a blast furnace or foundry and delivered prefabricated and assembled at the desired site. The joints of the components of the blocks and walls, generally of poured metallurgical slag, can be made of heavy granulated slag mortar, to which optionally is added granules of barite, cast iron or the like, the cement used preferably being made up of a cement with a high blast furnace slag content. According to a variant, it is possible to join the poured slag blocks with molten lead.

Various slags and scorias are suitable for use in the process of the present invention. Of the most suitable, there can be cited as production sources blast furnaces and steel mills, foundries, installations making ferroalloys, such as silicochromium and silicomanganese, lead-zinc smelters, copper smelting, manufacture of phosphorus by electric furnace, etc. However, it is advantageous to use molten products with a slight basicity index whose crystallization temperature is lower than that of said basic slags. These slags are most suitable for retaining a high degree of vitrification. Preferably, also for this purpose, slags can be selected that have considerable content of heavy metals (FeO, $Cr_2O_3$, MnO, NiO) coming from the ferroalloy industry or lead, zinc and copper metallurgy, because the presence of metal oxides increases the absorbing properties of the slags in regard to radioactive radiation.

BRIEF DESCRIPTION OF THE DRAWINGS

The invention will be illustrated below, in a non-limiting example, by an embodiment relating to the making of a protective covering for containers intended for storage of solid or pasty radioactive wastes. Reference is made to the single FIGURE in the accompanying drawing showing a diagrammatic sectional view of an embodiment of the present invention.

DETAILED DESCRIPTION OF PREFERRED EMBODIMENT

Into a metal external drum 1 of 200 liters, intended to act as a permanent casing, optionally circled by hoops, is placed a metal container 2 of smaller volume (60 or 100 liters) by placing it on supports 3 of refractory brick and wedging it against the walls of drum 1 with pieces of crushed slag 4. This container, whose upper part is in the form of a frustum, is equipped with a pipe 5, fastened by screwing or welding, intended for introduction of the material to be covered.

To test first of all whether it was possible to cover metal drums in a layer of molten slag without causing degradation, inside drum 2 was filled with dry siliceous sand through mouth 5 then molten slag 6 was poured (in the vicinity of a blast furnace) into the casing between the two drums, totally filling this free space and burying upper part 7 of drum 2 under a slag layer about twenty centimeters thick. It was allowed to cool slowly while sprinkling on surface 8 perlite or vermiculite to which was added aluminum powder in a layer about five centimeters thick to avoid a rapid cooling of the surface and to facilitate release of gases trapped in the slag. This slow cooling, favoring the gradual elimination of heat stresses, made it possible to avoid practically all cracking.

After cooling, the siliceous sand was emptied from drum 2. Then, following the usual precautions, granulates of moderately radioactive nuclear wastes were introduced into the drum 2 up to the upper frustum shaped part of the drum. A plug of heavy concrete was then placed in mouth 5.

A series of tests of this type made it possible to determine that such fluid-tight coverings would give a good protection from radioactive radiation coming from the wastes contained in inside drum 2. For example, tests showed that, for an average thickness of only 50 mm of blast furnace slag between walls 1 and 2, half of the radiation given off by an iridium 192 source of 7 curies activity was absorbed by the slag layer. The composition of this slag had been modified by addition of iron oxides and borate. To obtain even better security and increase the heat resistance of the drums, it is preferable to cover the inside wall of drum 1 and the outside wall of drum 2 with a thin layer of refractory concrete, for example one to two centimers thick, by guniting or similar process.

Of course, the above embodiment applies to containers of any shape and size and to elements (walls or the like) with unlimited thickness and surface. Further, the invention extends to use of equivalent technical means for obtaining the results contemplated.

I claim:

1. A process for shielding radiation emanating from radioactive products to permit storage, handling and shipping without danger, comprising:

placing elements made up of materials selected from the group consisting of molten slag and scorias, coming from a ferrous or nonferrous metal production operation, between the radioactive products and the outside environment to be protected.

2. A process in accordance with claim 1 wherein said elements are shaped into walls, slabs or blocks and constructed into enclosed spaces sheltering the radioactive products.

3. A process in accordance with claim 1 wherein said elements are shaped into conduits for movement of radioactive products in the form of radioactive effluents.

4. A process in accordance with claim 1 wherein the radioactive products comprise solid or pasty radioactive wastes enclosed in a metal container and said placing step comprises wedging said metal container within a larger empty outside drum such as to leave a space between the container and the drum on all sides, pouring molten slag or scoria into the free space between the container and the drum, and cooling slowly to avoid any cracking.

5. A process in accordance with claim 4, further including, after said pouring step and before said cooling step, covering the surface of the slag with an insulating or exothermal product of the perlite or vermiculite type, to which metallic powder has been added, thereby allowing gas trapped in the slag to escape and thus increase the density of the protective slag layer.

6. A process in accordance with claim 1 wherein said molten slags and scorias came from a blast furnace, a steel mill, a foundry, a ferroalloy fabrication plant, a lead-zinc smelter, a copper smelting plant, or a plant for the fabrication of phosphorus by electric oven.

7. A process in accordance with claim 6 wherein the slags and scorias have a slight basicity index and contain heavy metal oxides.

8. A process in accordance with claim 6 wherein the molten slags and scorias have added thereto one or more slag substances selected from the group consisting of sodium borate, sodium carbonate, siliceous sand and iron oxides, in an amount sufficient to lower the solidification temperature and/or increase the fluidity of the molten slag.

9. A container for the storage of solid or pasty radioactive wastes comprising a metal container within and spaced from a larger metal drum, the free space between said container and said drum being filled with a material formed by pouring molten slag or scoria coming from a ferrous or nonferrous metal production operation into said free space and allowing said molten slag or scoria to cool slowly to avoid cracking.

10. A container in accordance with claim 9 wherein said molten slag or scoria used to fill said free space has a slight basicity index and contains heavy metal oxides.

* * * * *